US006091365A

United States Patent [19]

Derneryd et al.

[11] Patent Number: 6,091,365

[45] Date of Patent: Jul. 18, 2000

[54] ANTENNA ARRANGEMENTS HAVING RADIATING ELEMENTS RADIATING AT DIFFERENT FREQUENCIES

[75] Inventors: Anders Derneryd, Hisings-Backa; Martin Johansson, Mölndal; Zvonimir Sipus, Göteborg, all of Sweden

[73] Assignee: Telefonaktiebolaget LM Ericsson, Stockholm, Sweden

[21] Appl. No.: 09/027,740

[22] Filed: Feb. 23, 1998

[30] Foreign Application Priority Data

Feb. 24, 1997 [SE] Sweden ..... 9700630

[51] Int. Cl.[7] ..... H01Q 1/38

[52] U.S. Cl. ..... 343/700 MS

[58] Field of Search ..... 343/700 MS, 853, 343/846, 847, 848, 829, 830

[56] References Cited

U.S. PATENT DOCUMENTS

| | | | |
|---|---|---|---|
| 4,520,329 | 5/1985 | D'Oro et al. | 333/135 |
| 5,001,493 | 3/1991 | Patin et al. | 343/700 MS |
| 5,216,430 | 6/1993 | Rahm et al. | 343/700 MS |
| 5,453,751 | 9/1995 | Tsukamoto et al. | 343/700 MS |
| 5,497,164 | 3/1996 | Croq | 343/700 MS |
| 5,534,877 | 7/1996 | Sorbello et al. | 343/700 MS |
| 5,633,646 | 5/1997 | Strickland | 343/700 MS |
| 5,661,493 | 8/1997 | Uher et al. | 343/700 MS |

FOREIGN PATENT DOCUMENTS

| | | |
|---|---|---|
| 2 157 500 | 10/1985 | United Kingdom . |
| WO96/17400 | 6/1996 | WIPO . |

OTHER PUBLICATIONS

A. A. Aziz et al., "Dual Band Circularly Polarised Microstrip Array Element,",*Proc. Journe'es Internationales de Nice sur les Antennes*(Jina 90), Nov. 1990, pp. 321–324.

J.R. James, "Superimposed Dichroic Microstrip Atenna Arrays," *IEEE Proceedings*, vol. 135, Pt.H, No. 5, Oct. 1988, pp. 304–212.

*Primary Examiner*—Tan Ho

*Attorney, Agent, or Firm*—Burns, Doane, Swecker & Mathis, L.L.P.

[57] ABSTRACT

An antenna arrangement includes a number of first radiating elements radiating in a first frequency band and a number of second radiating elements radiating in a second frequency band. The first and the second radiating elements are arranged in different planes. The second radiating elements are arranged in relation to the first radiating elements in such a way that each second radiating element partly overlaps the corresponding first radiating element. Each radiating element has at least one resonant dimension and the resonant dimension of the first radiating element is approximately twice the resonant dimension of the second radiating elements and the second radiating elements radiate at a frequency, or in a frequency band, which is approximately twice that of the first radiating element(s).

34 Claims, 11 Drawing Sheets

ANTENNA ARRANGEMENTS HAVING RADIATING ELEMENTS RADIATING AT DIFFERENT FREQUENCIES

BACKGROUND

The present invention relates to an antenna arrangement comprising a number of radiating elements of which some radiate at a first frequency or in a first frequency band and some radiate at a second frequency or in a second frequency band so that one and the same antenna arrangement can be used for different frequencies or frequency bands.

The invention also relates to a base station antenna arrangement that can be used for a first and a second frequency band so that one and the same base station antenna arrangement can be used for different mobile communication systems operating in different frequency bands.

The field of mobile telecommunications is rapidly growing in a large number of countries and new markets and more countries are constantly introducing cellular communication systems. Furthermore new services and applications are continuously introduced on the, in every aspect, strongly expanding mobile telecommunication market. It is well known that a number systems operating in approximately the 900 MHz frequency band, for example NMT 900, (D)-AMPS, TACS, GSM and PDC, have been very successful. This has among other things had as a consequence that systems operating in other frequency bands are needed. Therefore new systems have been designed for the frequency bands around 1800 MHz and 1900 MHz. Examples thereon are DCS 1800 and PCS 1900. There are of course also a number of other systems in the 900 MHz band (and there around) as well as in the 1800 or 1900 MHz and similar which have not been explicitly mentioned herein. Bearing the recent development in mind, it is also clear that still further systems will be developed.

However, for the operation of cellular mobile telecommunication systems a large number of base station antenna installations have been necessary. Base station antenna arrangements have to be provided all over the area that is to be covered by the cellular communication system and how they are arranged among other things depends on the quality that is required and the geographical coverage, the distribution of mobile units etc. Since radio propagation depends very much on terrain and irregularities in the landscape and the cities the base station antenna arrangements have to be arranged more or less closely.

However, the installation of base station antennas has caused protests among others from an esthetical point of view both on the countryside and in the cities. Already the installation of masts with antennas for e.g. the 900 MHz frequency band has given rise to a lot of discussions and protests. The installation of additional base station antenna arrangements for another frequency band would cause even more opposition and it would indeed in some cases give rise to inconveniences, not only from the esthetical point of view. Still further the construction of antenna arrangements is expensive.

The introduction of new base station antenna arrangements would be considerably facilitated if the infrastructure that already is in place for for example the 900 MHz frequency band could be used. Since both systems operating in the lower as well as in the higher frequency band furthermore will be used in parallel, it would be very attractive if the antennas for the different frequency bands could coexist on the same masts and particularly use (share) the same antenna aperture. Today various examples of microstrip antenna elements which are capable of operating in two distinct frequency bands are known. One way of achieving this consists in stacking patches on top of each other. This works satisfactorily if the different frequency bands are spaced closely e.g. up to a ratio of about 1.5:1. However, this concept does not work when the frequency bands are less closely spaced. An example thereon is a stacked dual frequency patch element comprising a ground plane, on which e.g. a circular or a rectangular low frequency patch is arranged and on top of which a high frequency patch of a similar shape is arranged. In still another known structure, as for example disclosed in "Dual band circularly polarised microstrip array element" by A. Abdel Aziz et al, Proc. Journe'es Internationales de Nice sur les Antennes (JINA 90), pp 321–324, Nov. 1990, School of El. Engineering and Science Royal Military College of Science, Shrivenham, England, a large low frequency patch element is provided in which a number of windows (four windows) are provided. In these windows smaller patch elements are arranged. The windows do not significantly perturb the characteristics of the larger patch element. Through this arrangement it is possible to use one and the same antenna arrangement for two different frequency bands, which however are separated by a factor four. This is a frequency band separation which is much too high to be used for the, today, relevant mobile communication systems operating at about 900 MHz and 1800 (1900–1950) MHz.

Still another known technique uses the frequency selective nature of periodic structures. It has been shown that when a low frequency patch element is printed as a mesh conductor or as a perforated screen, it can be superimposed on top of another array antenna operating at a higher frequency, c.f. e.g. "Superimposed dichroic microstrip antenna arrays" by J. R. James et al, IEE Proceedings, Vol. 135, Pt. H, No.5, October 1988. This works satisfactorily for dual band operations where the bands are still more separated than in the preceding case, thus having ratios exceeding 6:1. Furthermore U.S. Pat. No. 5,001,493 shows a multiband gridded focal plane array antenna providing simultaneous beams of multiple frequencies. A metallization pattern provides a first set of conductive edges of a first length and a second set of conductive edges having a second length. The first and second sets of conductive edges are separately fed to provide first and second simultaneously output beams at the first and second operating frequencies. However, also here it is not possible to have the frequency band separation that is about two thus being useful for the mobile communication systems referred to above. U.S. Pat. No. 5,001,493 shows second radiating elements radiating at an intermediate second frequency being 2.3 times a first frequency and the third radiating elements radiating at a high frequency being about 1.1 times the second frequency. Thus the antenna arrangement as disclosed in said document is not applicable to the mobile communication systems referred to above or in general where the frequency band separation is about a factor two.

In array antennas, the element periodicity is between 0.5 and 1 free space wavelengths. The smaller spacing is used in scanned array antennas. The number of radiating elements in the 1800/1900 MHz band will be twice as many as in the 900 MHz band if the same area is utilised. This means that the high frequency antenna will have between 3 and 6 dB higher gain than the low frequency antenna. This offsets partly the increased path losses at higher frequencies making the coverage areas similar for the two bands.

Diversity antenna configurations are used today to reduce fade effects. Receive diversity at the base station is achieved with two antennas separated a couple of meters. Today, mainly vertically polarised transmit and receive antennas are employed. Polarisation diversity is another way to reduce fade effects.

SUMMARY

What is needed is therefore an antenna arrangement which can be used for a frequency band separation of about a factor two, or particulary an antenna radiating element which can be used for a first and a second frequency, wherein the frequencies differ approximately by a factor two. What is needed is particularly an antenna arrangement and a base station antenna arrangement which can be used for two frequency bands with a separation factor between about 1.6–2.25.

Thus, what particularly is needed is an antenna arrangement or particularly a base station antenna arrangement, which can be used for cellular mobile telecommunication systems operating in the 900 MHz band such as NMT 900, (D)-AMPS, TACS, GSM, PDC etc. and another mobile communication system operating in the frequency band of about 1800 or 1900 MHz, such as for example DCS 1800, PCS 1900 etc.

Particularly an arrangement is needed through which either vertically/horizontally polarised antennas or antennas polarised in ±45° respectively can be provided.

What is needed is thus an antenna arrangement or a base station antenna arrangement wherein the same masts can be used for two different systems operating in two different frequency bands differing about a factor two and particularly the masts or infrastructure that already exist can be used for both kinds of systems and also for future systems operating in either of the two frequency bands.

Particularly a dual or a multifrequency antenna arrangement is needed which supports different polarisation states. Particularly also sector antenna arrangements and multibeam array antenna arrangements are needed which at least combine operations in at least two different frequency bands, differing approximately by a factor two, in one and the same arrangement.

Therefore an antenna arrangement is provided which comprises a conductive ground plane, at least a number of first radiating elements radiating at the first frequency and a number of second radiating elements radiating at a second frequency, wherein to each first radiating element at least a group of second radiating elements are arranged. The at least first and second radiating elements are arranged in different planes. The second radiating elements of a group are advantageously symetrically arranged in relation to the corresponding first radiating elements in such a way that each second radiating element partly overlaps the corresponding first radiating element. Each radiating element, i.e. first as well as second radiating elements, have at least one effective resonant dimension and the effective resonant dimension of the first radiating element is substantially twice that of the effective resonant dimensions of the second radiating elements so that the second radiating elements radiate at a frequency, or in a frequency band, which is approximately twice that of the first radiating element.

Advantageously each radiating element comprises a patch made of a conductive material. According to different embodiments a layer of air is provided between the layers of the first and second radiating elements and/or between the ground plane and the lowest layer of radiating elements. As an alternative to air, dielectric layers can be used. Such a dielectric layer can be arranged between the respective layers of radiating elements and it can also be arranged between the lowest layer of radiating element(s) and the ground plane. The ground plane may for example comprise a Cu-layer. Advantageously at least one resonant dimension of the first radiating element is approximately half the wavelength corresponding to a first frequency and at least one resonant dimension of a second radiating element is approximately half the wavelength corresponding to the second radiating frequency. The first radiating elements are energized to radiate at the lower frequency (or in the lower frequency band) whereas the second radiating elements are energized to radiate at the higher frequency (in the higher frequency band). According to different embodiments the first frequency radiating elements are arranged above or below the layer of second radiating elements. Both alternatives are possible. Still further, according to different embodiments, the radiating elements may comprise rectangular patches, square patches or circular patches. Generally both the first and the second radiating elements in an antenna arrangement are of the same form but it is also possible that for example a first radiating element is square or rectangular whereas the second radiating elements are circular or vice versa. However, if only one linear polarisation is used, rectangular patches are preferred although the invention is not limited thereto. On the other hand, rectangular patches are not used for dual polarisation cases.

For rectangular patches, it is sufficient that one dimension is effectively resonant, for example the length of the rectangle. If square radiating elements are used, it is of course the side of the patch that is resonant and if circular patches are used, it is the diameter that constitutes the resonant dimension. Advantageously square patches or circular patches are used for dual polarisation applications. Particularly is thereby referred to linear polarisation. It is however possible, as is known per se, to combine two linear polarisations to one or two orthogonal circular polarisations. In another alternative embodiment the resonant dimensions of the radiating elements of the first and the second elements respectively are rotated differently in relation to the previously described embodiments. This is applicable for single as well as for dual polarisations. In still another embodiment the first and the second radiating elements are rotated differently in relation to each other so that the polarisation of the first and the second elements respectively do not coincide. Also this form can be applied for single as well as dual polarisation cases.

According to one embodiment the antenna arrangement comprises one first radiating element and four second radiating elements, thus forming a single dual frequency patch antenna element.

In an alternative embodiment, however, a number of first radiating elements are provided to which corresponding second radiating elements are arranged groupwise to form an array lattice. In an array, any of the elements described above can be used. The elements in one embodiment arranged are in rows and columns in such a way that the resonant dimensions are parallell/orthogonal to the rows/columns. In another embodiment the elements are rotated to form an angle of approximately 45° in relation to the rows/columns in which they are arranged.

In still another embodiment, for each first radiating element, two second radiating elements are provided which are arranged opposite each other and partly overlapping the first element. This is particularly advantageous for sector antennas comprising a column of such elements.

Particularly the arrangement comprises a dual frequency, dual polarisation antenna or even more particularly a multifrequency, multi-polarisation antenna.

The feeding of the radiating elements can be provided for in a number of different ways. According to one embodiment so called aperture feeding is applied. This is particularly advantageous when the low frequency radiating elements are arranged above the high frequency (smaller) radiating elements. The second radiating elements are then aperture fed from below through apertures arranged in relation to the corresponding radiating elements in the ground plane. Through this embodiment the manufacturing costs and potential passive intermodulation (PIM) sources are reduced. Of course also the first radiating element is fed via an aperture arranged centrally in relation thereto in the ground plane. The feeding as such is provided by a first and a second microstrip line which excite the radiating elements through the respective apertures without any physical contact. In an alternative embodiment so called probe feeding is used. If the high frequency radiating elements are arranged above the low frequency radiating element, the probes (here) eccentrically feed the second radiating elements.

A base station antenna arrangement is also provided which at least comprises a number of first antennas intended for a first mobile telecommunication system operating in a first frequency band and a number of second antennas used for a second mobile telecommuniation system operating in a second frequency band which is approximately twice that of the first frequency band and wherein the antennas for the first and the second system respectively coexist on one and the same mast. The antenna elements, or the radiating elements, are of the kind as described in the foregoing. Advantageously the separation ratio between the frequency bands lies between approximately 1.6–2.25:1. According to different embodiments the antennas are sector antennas or multiple beam array antennas.

It is an advantage of the invention that the existing infrastructure already provided for the 900 MHz frequency band can be used also for new frequency bands such as about 1800 MHz or 1900 MHz. It is also an advantage of the invention that the antenna elements or the radiating elements are simple and flexible and enables a simple feeding technique etc. A particular advantage is that the same kind of radiating elements can be used for both frequencies merely the size as given by the resonant dimensions, differing. It is also an advantage that dual polarisation states can be supported.

However, it is also an advantage that not only dual frequency, dual polarisation antenna arrangements can be provided but also multi-frequency arrangements; i.e. with more than two frequencies. Then e.g. another layer of radiating elements may be arranged on top of the uppermost layer in a similar manner. If for example four second radiating elements are arranged above a first radiating element, sixteen third radiating elements may be arranged above the second radiating elements which radiate in a third frequency band with a frequency about twice the second frequency.

BRIEF DESCRIPTION OF THE DRAWINGS

The invention will be further described in the following in a non-limiting way with reference to the accompanying drawings in which.

DETAILED DESCRIPTION

Figure 1A:
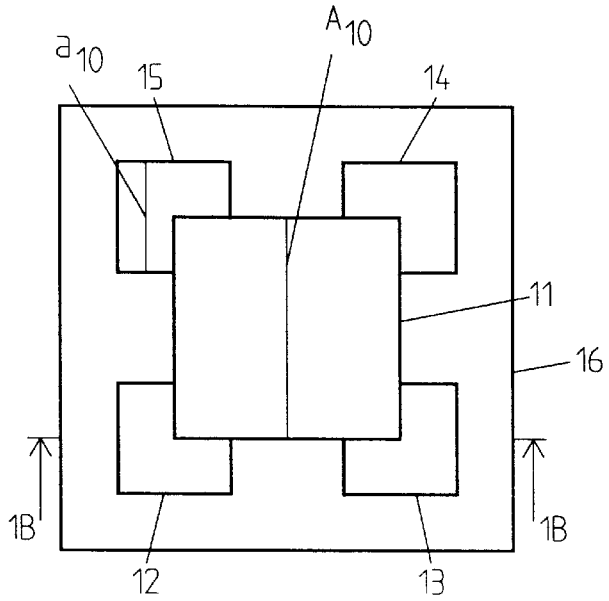
FIG. 1A is a top view of a dual frequency antenna arrangement comprising square shaped patches.
Figure 1B:
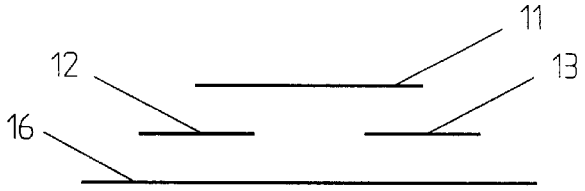
FIG. 1B is a schematical cross-sectional view of the antenna arrangement of FIG. 1A along the lines 1B—1B.

FIG. 1 shows a first example of a microstrip antenna arrangement 10 operating (receiving/transmitting) at two different frequencies or in two different frequency bands. In FIG. 1A, which is a top view of the antenna arrangement, 10 a first radiating element 11 is arranged on the top. The first radiating element 11 is here square shaped. Below the first radiating, element four second radiating elements 12,13,14, 15 are arranged. The second radiating elements do of course not have to be arranged in a centralized manner under the corners of the first radiating element. They may also be arranged more closely (or vice versa) in one or both directions. This also applies for the embodiments to be described below with reference e.g. to FIGS. 3A,4A,5 etc. The first and second radiating elements respectively particularly comprise so called patch elements. A patch element is a patch of a conducting material, for example Cu. The second radiating elements 12,13,14,15 are symetrically arranged in relation to the first radiating element and partly overlap the first radiating element 11. The distance between the center of two second radiating elements is approximately 0.5–1 times the wavelength in free space corresponding to the frequency of the second radiating elements. The distance may e.g. correspond to 0.8× the wavelength. Between the first radiating element 11 and the group of second radiating elements 12,13,14,15 e.g. an air layer is provided. Alternatively a dielectric layer is arranged between the first and second radiating elements respectively. If there is air between the first and second radiating elements, plastic studs or similar may be arranged as distance elements (not shown in the figures). Below the second radiating elements a conductive layer 16 is arranged. This is illustrated in a simplified manner in FIG. 1B which is a cross-section along the lines 1B—1B in FIG. 1A. According to one embodiment a layer of air is provided between the second radiating elements and the conductive layer 16. Alternatively a dielectric layer is arranged between the second radiating elements 12,13,14,15 and the conductive layer 16. The first and the second radiating elements respectively are separately energized (excited) or separately fed to reradiate the energy or to simultaneously output beams at a first, lower, operating frequency and a second, higher, operating frequency respectively. The first and the second frequencies differ by a factor of approximately 1.6–2.25, or approximately there is a factor two between the first and the second operating frequency so that a first patch element or radiating element 11 can be used for a communication system operating in frequency band of about 800–900 MHz, whereas the second radiating elements 12,13,14,15 can be used for a communication system operating in the frequency band of about 1800–1900 MHz. The first and the second radiating elements have a first and a second effective resonant dimension respectively. For the first radiating element 11 the effective resonant dimension is given by the side $A_{10}$ of the square shaped element. In a similar manner the effective resonant dimensions of the second radiating elements 12,13,14,15 are given by the side $a_{10}$ of the likewise square shaped second radiating elements. The resonant dimensions $A_{10}$ and $a_{10}$ are approximately half the wavelength of the relevant first and second frequency respectively. If air is used the resonant dimensions (here e.g. $A_{10}$, $a_{10}$) are given by $$A_{10}=\lambda_1/2$$

and $$a_{10}=\lambda_2/2$$

wherein $\lambda_1$, $\lambda_2$ are the wavelengths in free space. If however a dielectric material is arranged between the first and second radiating elements and the ground layer, the dimensions can be made smaller and depend on the effective dielectric constant of the dielectric material, i.e.

$$A_{10}=\lambda_1/2\sqrt{\epsilon_r}$$

wherein $\epsilon_r$ is the relative dielectric constant; similar for $a_{10}$. Feeding can be provided in any appropriate manner which will be further discussed below. According to one embodiment so called aperture feeding is used. According other embodiments probe feeding is used or alternatively electromagnetic energy can be coupled through resonators or any combination of feeding.

In an advantageous embodiment the lower, second radiating elements, i.e. the high frequency patches are aperture fed from below. Also the first radiating element is fed from below. Therethrough the manufacturing costs can be reduced and further potential passive intermodulation (PIM) sources can be reduced.

Figure 2A:
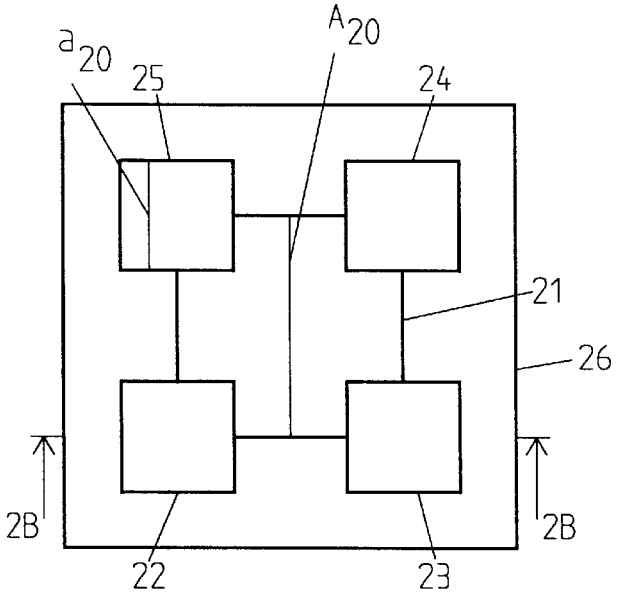
FIG. 2A is a top view of an alternative dual frequency antenna arrangement comprising square shaped patches.
Figure 2B:
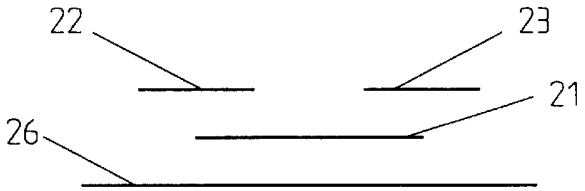
FIG. 2B is a schematical cross-sectional view of the antenna arrangement of FIG. 2A along the lines 2B—2B.

In FIG. 2A an alternative dual frequency antenna arrangement 20 is illustrated. In FIG. 2B a simplified cross-sectional view along the lines 2B—2B in FIG. 2A is illustrated.

Also in this case square shaped patches are used for the first as well as the second radiating elements. However, in this case the second radiating elements 22,23,24,25 are arranged above the first radiating element 21. Thus the high frequency radiating elements are arranged above the lower frequency radiating element in contrast to the embodiments illustrated with reference to FIG. 1A and 1B. Also in this case either a dielectric layer may be arranged between the first radiating element 21 and the conductive ground plane 26 or alternatively air is provided therebetween. In a similar manner a dielectric layer may be arranged between the first and the second radiating elements or alternatively air is provided therebetween as well. Also in this case the resonant dimensions are given by the sides $A_{20}$ and $a_{20}$ of the square shaped patches forming the first 21 and the second 22,23, 24,25 radiating elements respectively. Also here different feeding techniques can be used although it is less advantageous to use aperture feeding as compared to the embodiments as described with reference to FIG. 1A.

Figure 3A:
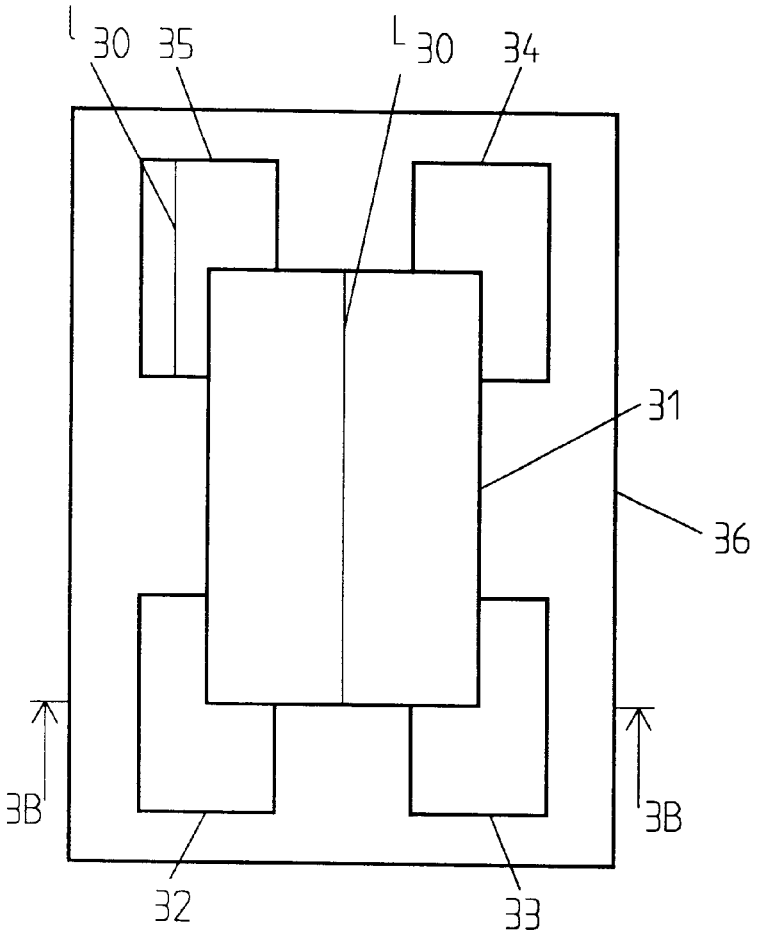
FIG. 3A is a top view of a dual frequency antenna arrangement comprising rectangular patches.
Figure 3B:
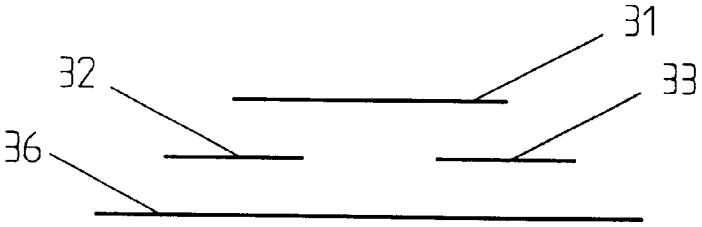
FIG. 3B is a cross-sectional view of the arrangement of FIG. 3A along the lines 3B—3B.

In FIG. 3A still another dual frequency antenna arrangement 30 is disclosed. In this case the first radiating element 31 is arranged on top, i.e. the lower frequency element. The form of the first radiating element 31 is rectangular and the effective resonant dimension $L_{30}$ is given by the length of the rectangle. As in the embodiments described above, the second radiating elements 32,33,34,35 have the same form as the first radiating element 31 and they are arranged in a symmetrical and partly overlapping manner. The second, higher frequency, radiating elements are here also rectangularly shaped (although this is not necessarily the case; they may also take other or different forms) and they have an effective resonant dimension $l_{30}$ being the length of the respective rectangles. In FIG. 3B a simplified cross-section along the lines 3B—3B of FIG. 3A is illustrated and also in similarity with the embodiments described above the dieletrica or air may be provided between the conductive ground layer 36 and the second radiating elements and between the first and the second radiating elements respectively. Also here the effective resonant dimensions $L_{30}$ and $l_{30}$ correspond to substantially half the wavelength corresponding to the desired frequencies which as referred to above differ approximately a factor of 2 so that the arrangement 30 can be used for the above discussed communication systems. Rectangular patches are particularly advantageous if only one linear polarisation is used. In principle square shaped patches (or at least symmetrical patches) are particularly advantageous for dual polarisation applications in which two dimensions are resonant, thus having given dimensions. For single polarisation cases, one dimension is not resonant. The non-resonant dimension may then determine the beamwidth in the plane of the non-resonant dimension.

It should be noted, however, that of course the embodiment as described with reference to FIG. 3A can be arranged differently so that the second or higher frequency radiating elements are arranged above the first, lower frequency, radiating element.

Figure 4A:
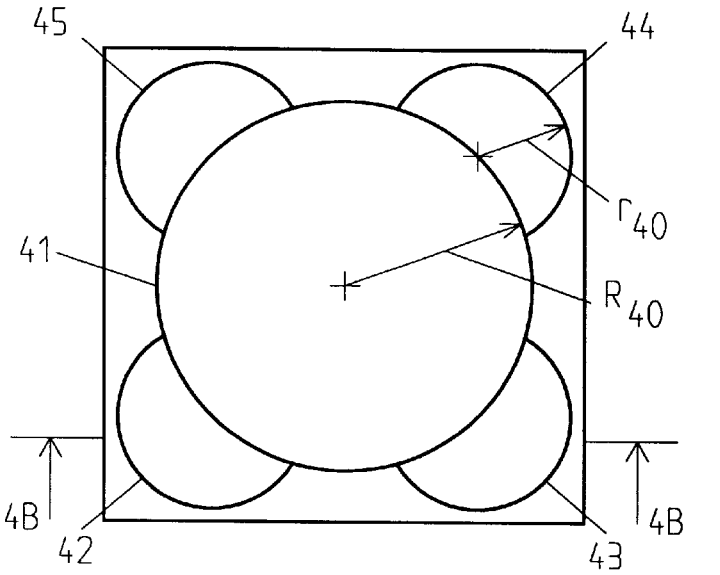
FIG. 4A is a top view of still another dual frequency antenna arrangement wherein the patches are circular.
Figure 4B:
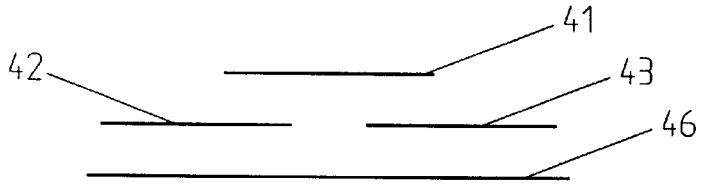
FIG. 4B is a cross-sectional view of the arrangement of FIG. 4A along the lines 4B—4B.

In FIG. 4A still another dual frequency antenna arrangement 40 is illustrated. A simplified cross-sectional view along the lines 4B—4B is schematically illustrated in FIG. 4B. In this arrangement the first and the second radiating elements respectively comprise circular patches. The first radiating element 41 is arranged above the second radiating elements 42,43,44,45 which are arranged centrically in relation to the first radiating element and in a partly overlapping manner.

Also here air or a dielectric material (at least partly covering the space between the elements) is arranged between the ground plane 46 and the second radiating elements and/or between the second radiating elements and the first radiating element 41.

The resonant dimensions are here given by the diameters of the radiating elements. The resonant dimension of the first radiating element 41 is given by the diameter (twice the radius) of the circular patch, the radius here being denoted $R_{40}$, $$R_{40}=1.841\lambda_1/2\pi\sqrt{\epsilon_r}\approx 0.29\lambda_1/\sqrt{\epsilon_r}.$$

In a similar manner the resonant dimensions of the second radiating elements are given by the corresponding diameters $2xr_{40}$ of the respective second radiating element. In other aspects the same applies as was discussed with reference to the square shaped embodiments. Of course the first radiating element can be arranged below the second or higher frequency radiating elements. Like square shaped patches, circular patches are particularly advantageous for dual polarisation applications although they may of course be used also if only one linear polarisation is used.

Figure 5:
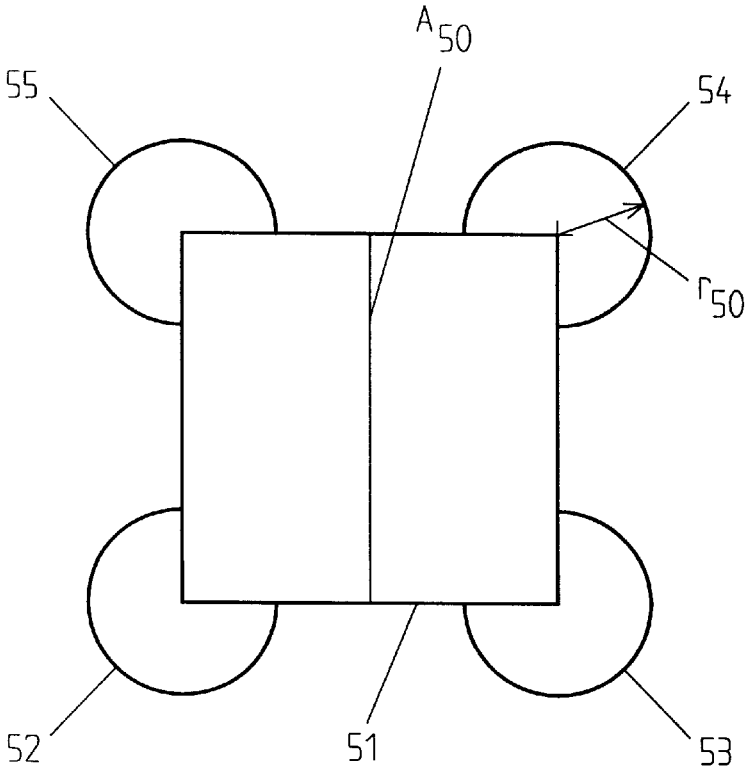
FIG. 5 is still another example of an antenna arrangement in which the first and second radiating elements have different shapes.

In FIG. 5 still another example of a dual frequency antenna arrangement 50 is disclosed. Here the first and second radiating elements have different forms. In this particular case the first radiating element 51 is arranged on top and comprises a square shaped patch, the resonant dimension $A_{50}$ being given by the side of the square. The second radiating elements 52,53,54,55 are circular and symetrically arranged in relation to the first radiating element 51 in a partly overlapping manner. For the second radiating elements the resonant dimensions are given by the diameters, i.e. twice the radii, $r_{50}$. It should however be clear that of course the first radiating element could have been arranged below the second radiating elements. Also in this case air and/or dielectrics is/are arranged between the first and the second radiating elements respectively and between the lower radiating elements and the conductive ground plane (not illustrated in the figure).

The discussions with reference to FIG. 1A relating to the relationship between the operating frequencies and thus the resonant dimensions of course also apply for the embodiments of FIGS. 2A,3A,4A,5 as well as for the figures to follow.

Figure 6:
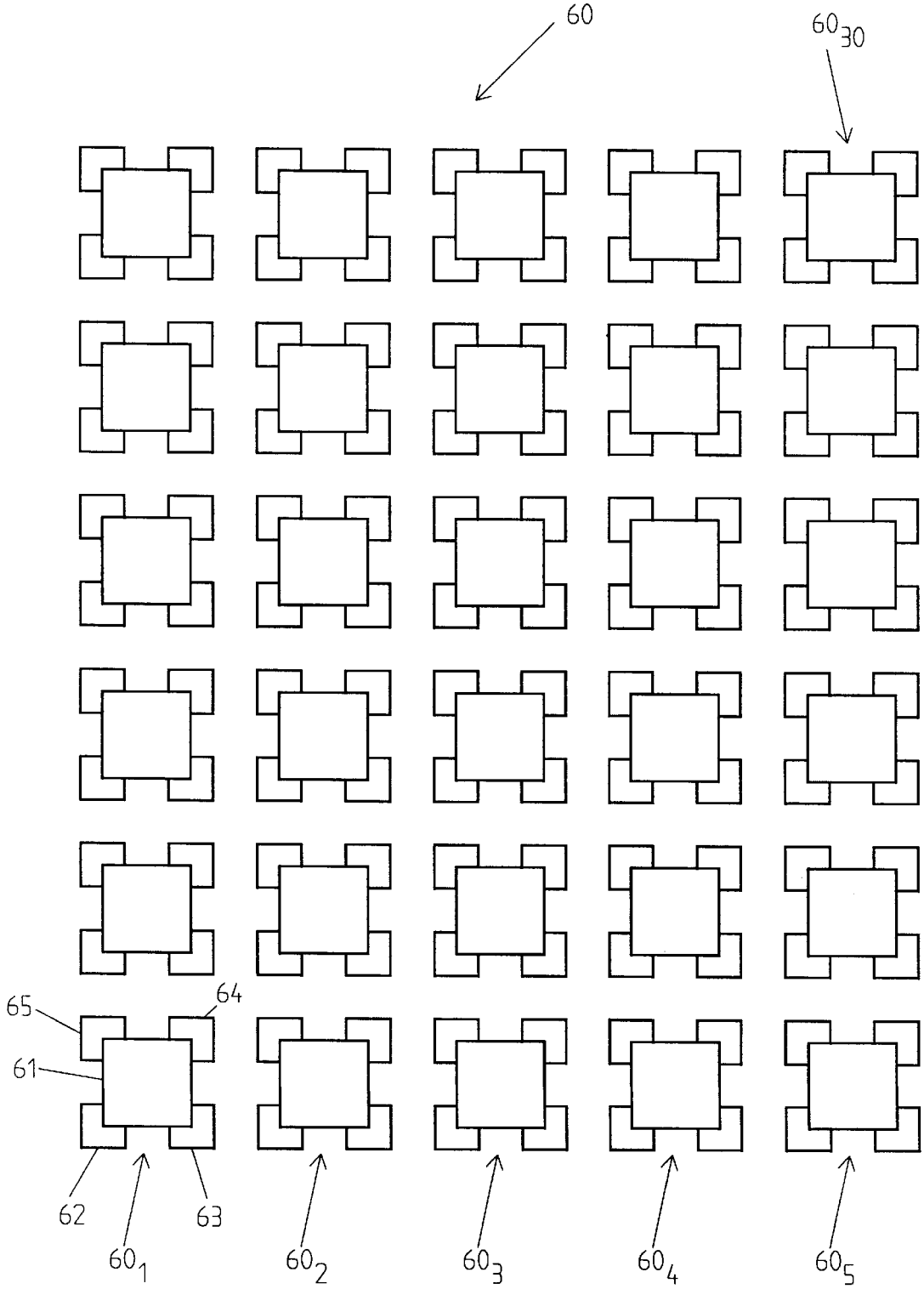
FIG. 6 is one example of a dual frequency/dual polarisation array antenna.
Figure 7:
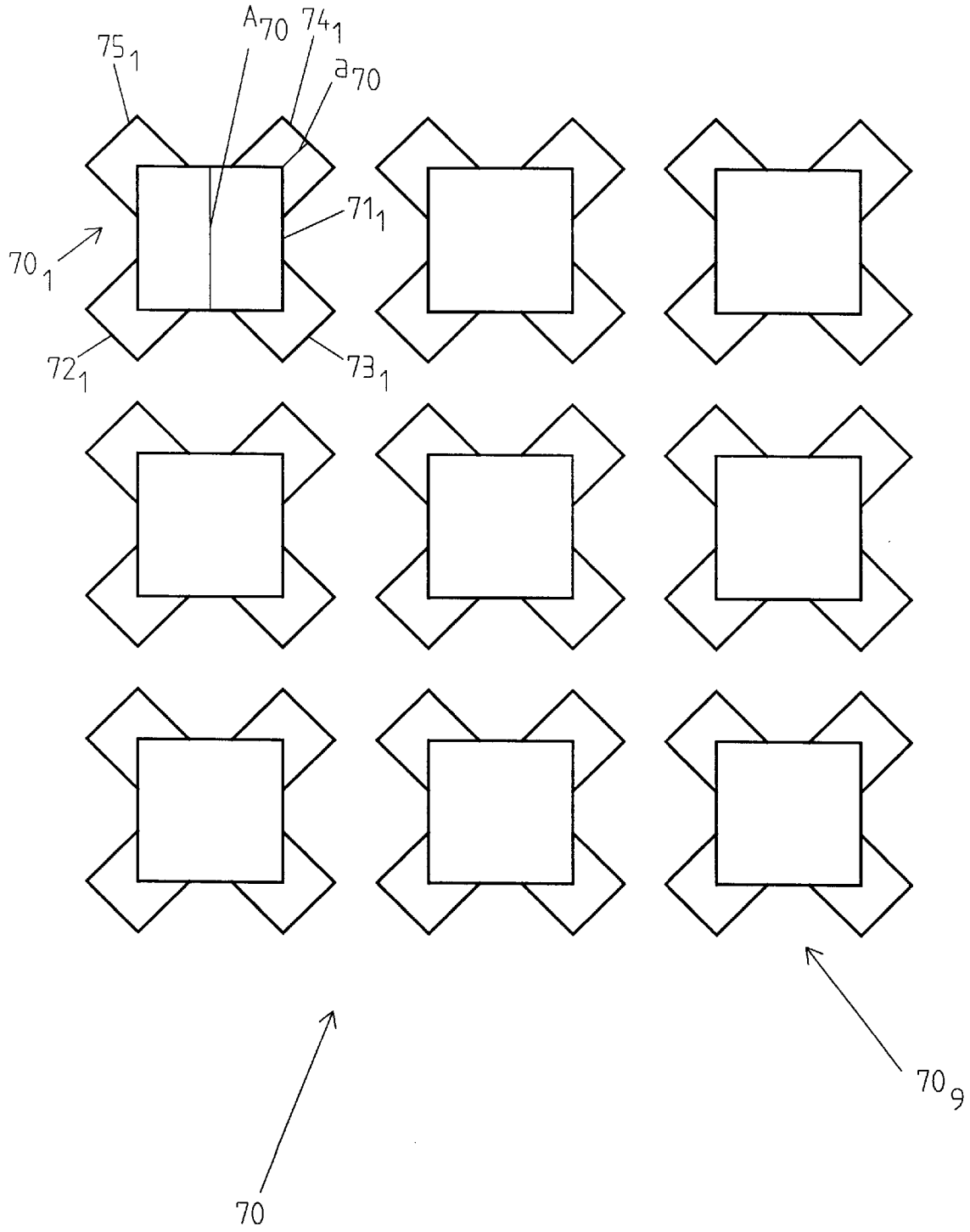
FIG. 7 is another embodiment of an antenna array wherein the resonant dimensions of the first and second radiating elements form an angle of 45° degrees with each other.

In FIG. 6 an antenna arrangement 60 in the form of an array lattice is illustrated. The antenna arrangement 61 comprises (here) 30 first radiating elements $\mathbf{60}_1$,$\mathbf{60}_2$, . . . ,$\mathbf{60}_{30}$ regularly arranged in a rectangular lattice structure. To each first radiating element $\mathbf{60}_1$,$\mathbf{60}_2$, . . . , four second radiating elements 62,63,64,65 are arranged in a manner similar to that of the arrangement as described in FIG. 1A. The first radiating elements are here arranged on the top, also similar to FIG. 1A, and the discussion relating to FIG. 1A is relevant also here. Particuarly the arrangement 60 comprises a dual frequency, dual polarisation arrangement since the radiating elements are regular and do comprise respectively two resonant dimensions, i.e. the sides of the square. Of course an array lattice can be formed in any manner, e.g. triangular, circular, elliptical etc., comprising any of the antenna arrangements 10,20,30,40,50 or any variation thereof relating to which kind of radiating elements are arranged on the top etc. and how they are rotated. For the dual frequency, dual polarisation antenna arrangement 60 a common ground plane is used which however is not illustrated herein and the feeding can be provided in any convenient manner as discussed above. Of course the number of radiating elements can be any appropriate number. In one embodiment the distance between second radiating elements is the same within a group as between adjacent second elements in adjacent groups both in the horizontal and the vertical direction. In an advantageous embodiment the distance between the second radiating elements is between approximately 0.5–1λ. Particularly it is as low as possible, e.g. about 0.5λ to provide large scan angle performance of the array, i.e. to avoid grating lobes. In another embodiment the distance is not exactly the same in the vertical direction as in the horizontal direction but e.g. somewhat smaller in the horizontal direction. In FIG. 7 another antenna arrangement in the form of an array lattice 70 is illustrated which comprises (in this particular case) nine dual frequency antenna elements $\mathbf{70}_1$, . . . , $\mathbf{70}_9$. Also in this case the first radiating elements $\mathbf{71}_1$, $\mathbf{71}_2$, . . . , $\mathbf{71}_9$ are arranged above the corresponding second radiating elements $\mathbf{72}_1$, $\mathbf{73}_1$, $\mathbf{74}_1$, $\mathbf{75}_1$, . . . , of which for reasons of clarity only the second radiating elements of the first dual frequency antenna $\mathbf{70}_1$ are provided with reference signs. Of course the second radiating elements could have been arranged on top of the first radiating elements instead; any variation is possible as in the foregoing discussed embodiments. The first and second radiating elements are also in this case square shaped, the first as well as the second radiating element. Furthermore the second radiating elements $\mathbf{72}_1$, $\mathbf{73}_1$, $\mathbf{74}_1$, $\mathbf{75}_1$, . . . , are also symmetrically arranged in relation to the first radiating element $\mathbf{71}_1$, . . . , $\mathbf{71}_9$ respectively but with the difference that the respective resonant dimensions $A_{70}$ and $a_{70}$ respectively form an angle of approximately 45° with each other. The radiating elements are symmetrical and each radiating element, as described above, comprise two resonant dimensions, i.e. the sides of the squares. However, the resonant dimensions of the first and the second radiating elements respectively form an angle of 45° with each other.

Figure 8:
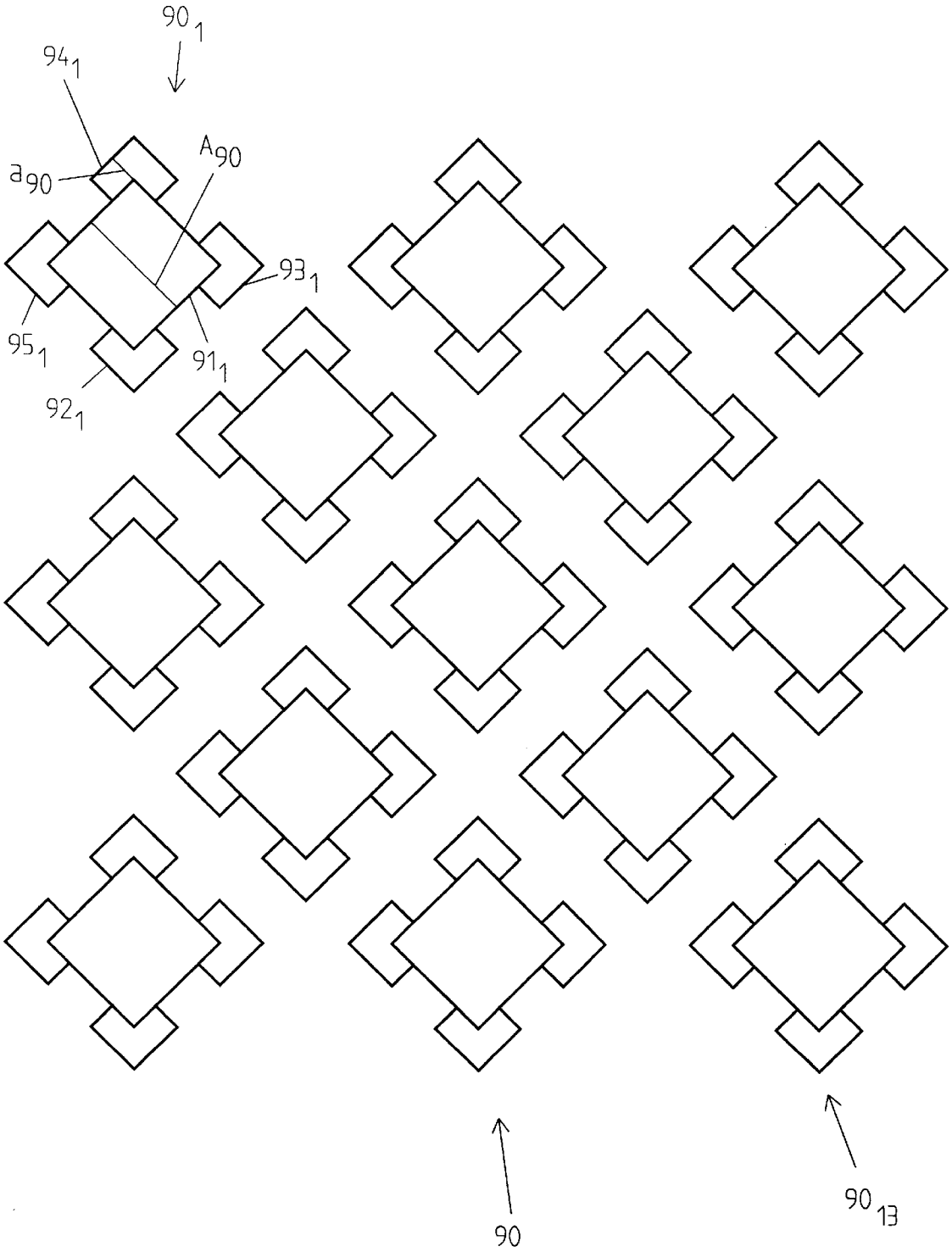
FIG. 8 is still another embodiment of an antenna array, FIG. 9 schematically illustrates an example of aperture feeding for example of the radiating elements of FIG. 1A, FIG. 10 schematically illustrates probe feeding of the radiating elements of FIG. 2A.

FIG. 8 shows an alternative embodiment of an array 90 comprising a number of dual frequency antenna elements $\mathbf{90}_1$, . . . , $\mathbf{90}_{13}$, polarised ±/−45°. The first radiating elements $\mathbf{91}_1$, . . . , $\mathbf{91}_{13}$ are arranged above the corresponding second radiating elements $\mathbf{92}_1$, $\mathbf{93}_1$, $\mathbf{94}_1$, $\mathbf{95}_1$; . . . , but in an alternative embodiment (not shown) the first radiating elements are arranged below the second radiating elements. The polarisation of the fist and second radiating elements is similar in the first and second frequency bands respectively. Antennas polarised in ±45° have shown to be advantageous since (for dual polarisation cases) the propagation properties of the electromagnetic waves are the same for the two polarisations and a similar damping (which is substantially the same for both polarisations) is provided as compared to the case in which vertical and horisontal polarisations are used.

Figure 9:
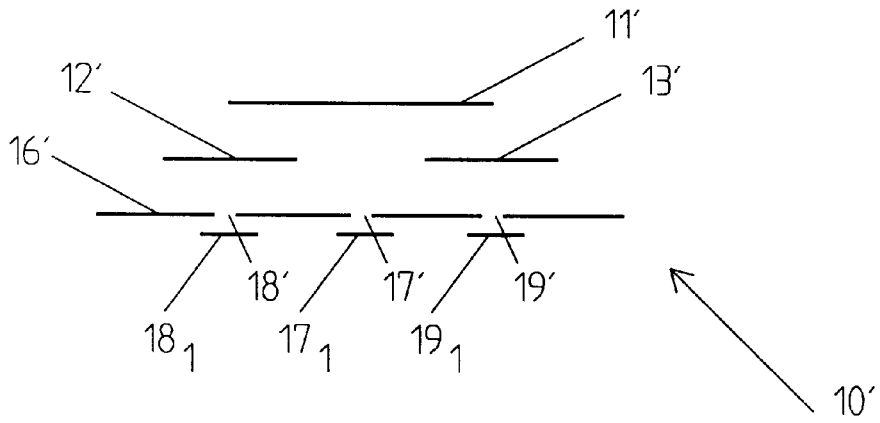

FIG. 9 is a simplified cross-sectional view corresponding to that of FIG. 1B, the radiating arrangement here being denoted 10'. It illustrates an example on aperture feeding. In the ground plane 16' a number of apertures for each first and second radiating elements are provided. In FIG. 9 the aperture corresponding to the first radiating element 11' is shown, but only two of the apertures corresponding to the second radiating elements are shown; aperture 18' corresponding to the second radiating element 12' and aperture 19' corresponding to the second radiating element 13'. Of course there are also apertures for the other second radiating elements. Via microstrip lines $\mathbf{17}_1$, $\mathbf{18}_1$, $\mathbf{19}_1$, the first radiating element 11' and the second radiating elements 12', 13' are energized through the apertures, however without any physical contact with the microstrip lines. The apertures have substantially the same length as the resonant dimension of the corresponding radiating element and they are arranged perpendicularly to the resonant length.

Figure 10:
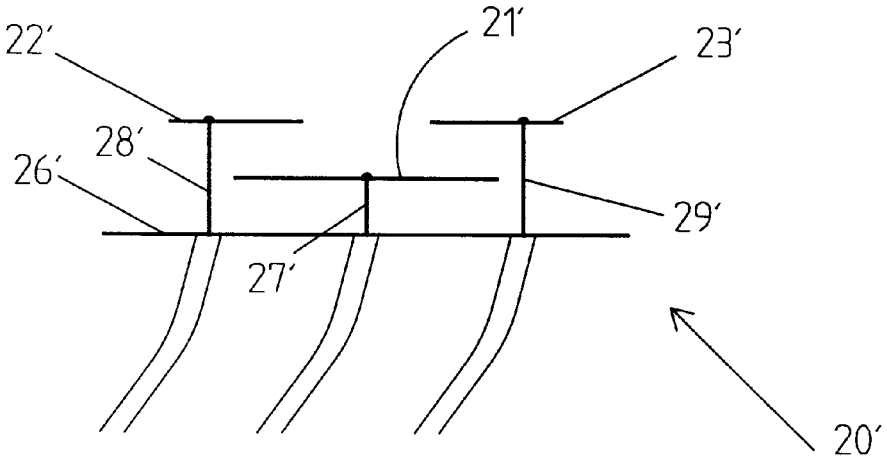

FIG. 10 is a cross-sectional view similar to that of FIG. 2B showing an antenna arrangement 20' (corresponding to antenna arrangement 20 of FIG. 2B) which is fed through probe feeding which as such is a feeding method known per se. Via probes 27', 28', 29' the first radiating element 21' and the second radiating elements 22' and 23' are fed via coaxial lines (for example). Also here the other second radiating elements are fed in a similar manner.

Figure 11:
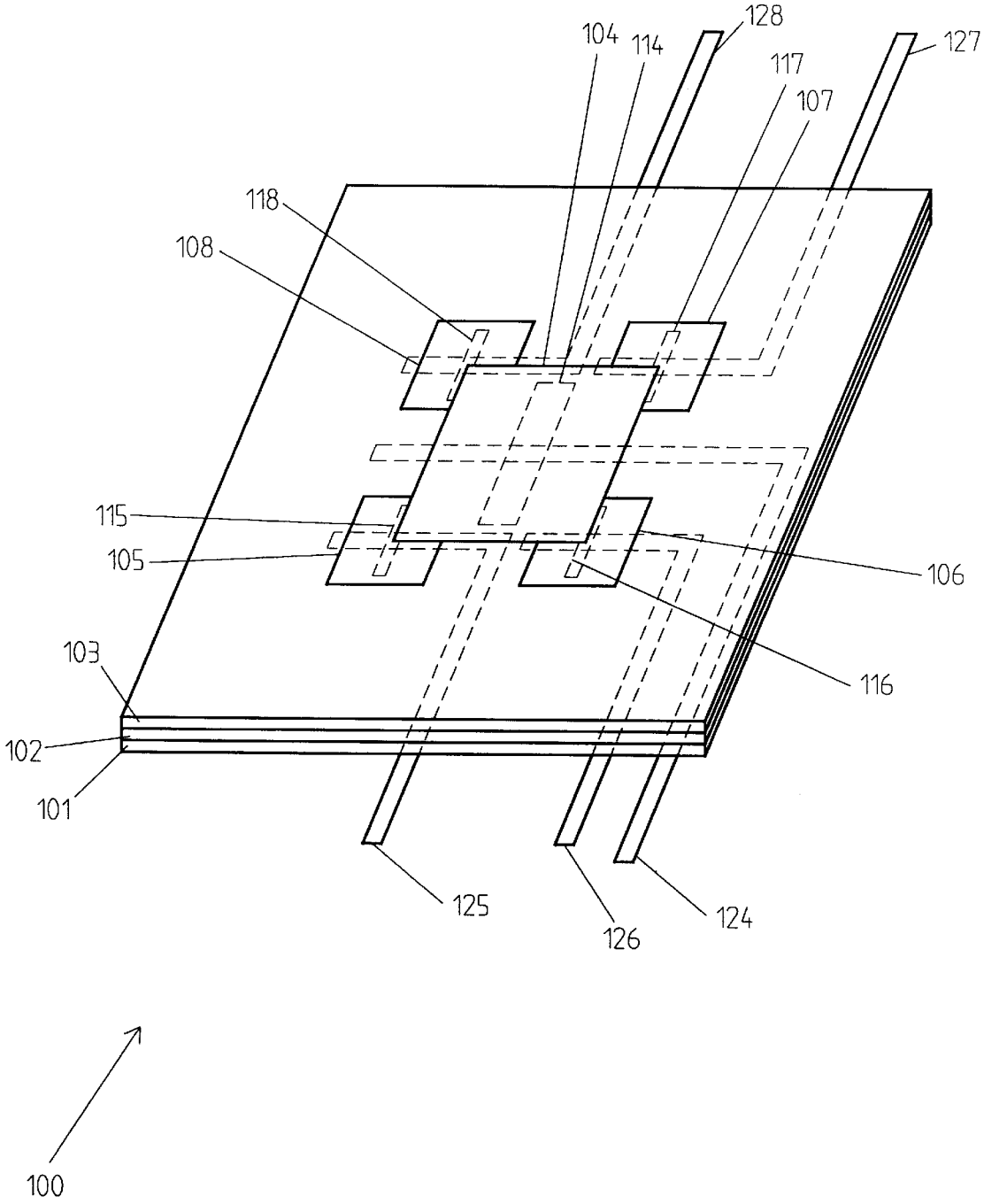
FIG. 11 is a cross-sectional perspective view illustrating aperture feeding of an arrangement as illustrated in FIG. 1A.

In FIG. 11 a cross-sectional perspective view of an antenna arrangement 100 is illustrated. The antenna arrangement comprises a first radiating element 104 and four second radiating elements 105,106,107,108, the first radiating element 104 being arranged on top of the second radiating elements. Of course it could also have been an array lattice but this is not illustrated for reasons of clarity. A conductive ground plane 102, for example of Cu, is arranged on a dielectric substrate 101. On top of the conductive ground plane 102 a dielectric layer 103 is arranged. In an alternative embodiment it could have been air in which case the spacing between second radiating elements and the ground plane could have been provided through the use of plastic studs or similar. For reasons of clarity there is no dielectric layer illustrated between the first and the second radiating elements although such a layer normally is provided (at least covering part of the space). Also here it can alternatively take the form of an air layer. In the conductive ground plane 102 a number of feeding apertures 114,115,116,117,118 are provided. The sizes of the feeding apertures relate to the sizes of the radiating elements and are substantially the same. Via microstrip lines 124,125,126,127,128 the first and the second radiating elements are fed. The feeding is provided through the microstrip lines 124,125,126,127,128 laterally crossing the apertures in an orthogonal manner without any physical contact. If there is just one aperture for each radiating element, a single polarisation beam is provided. Two examples on apertures for dual polarisation cases are very schematically illustrated in FIGS. 14A and 14B.

Figure 12:
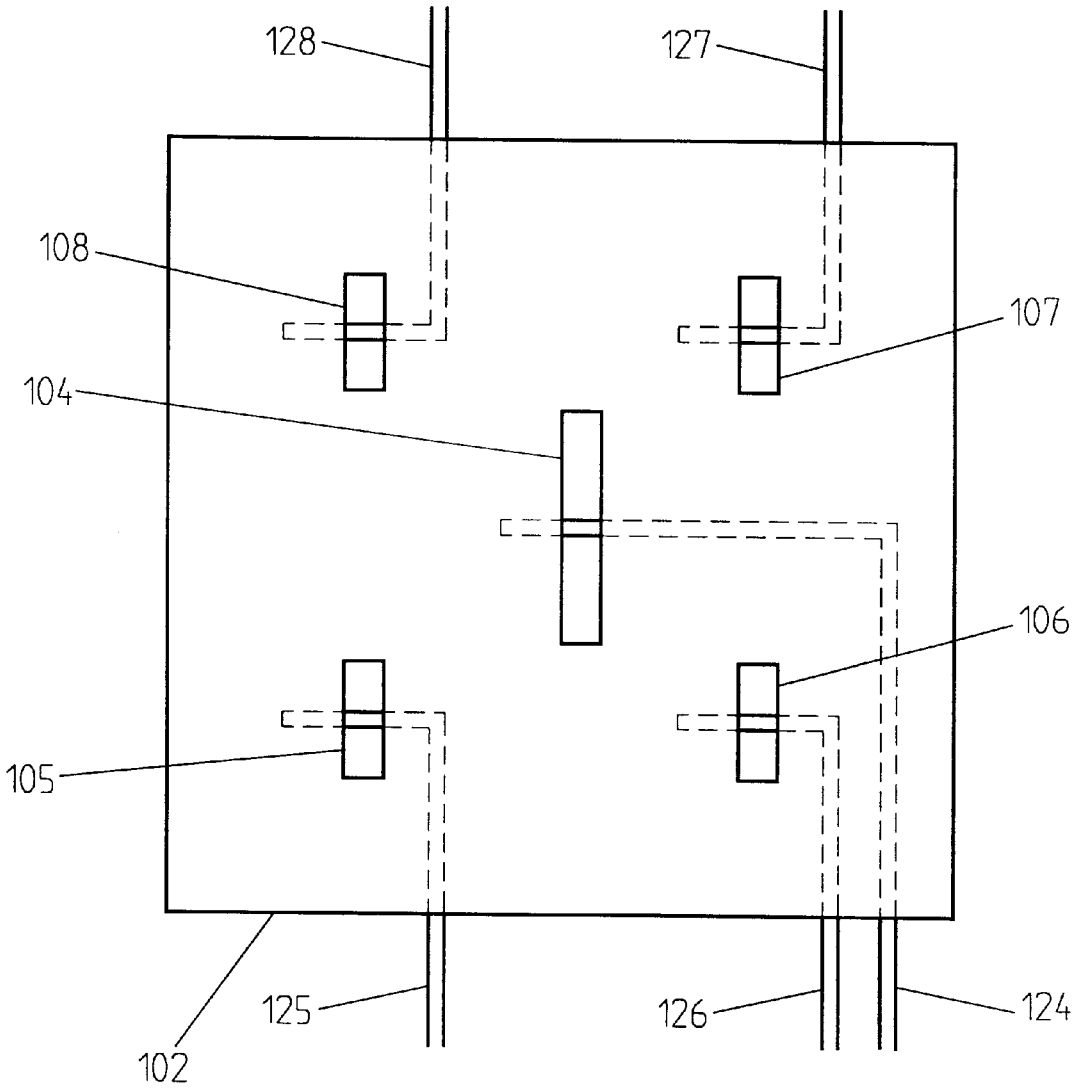
FIG. 12 is a top view of the ground plane comprising feeding apertures for a single polarisation case.

In FIG. 12 the conductive ground plane 102, in which the apertures are provided, is more clearly illustrated. The apertures 104,105,106,107,108 correspond to the first and the second radiating element respectively. The microstrip line 124 is arranged below the ground plane 102 and crosses aperture 104 in an orthogonal manner as described above and the microstrip lines 125,126,127,128 pass under the apertures 105,106,107,108 in a similar manner.

Figure 13:
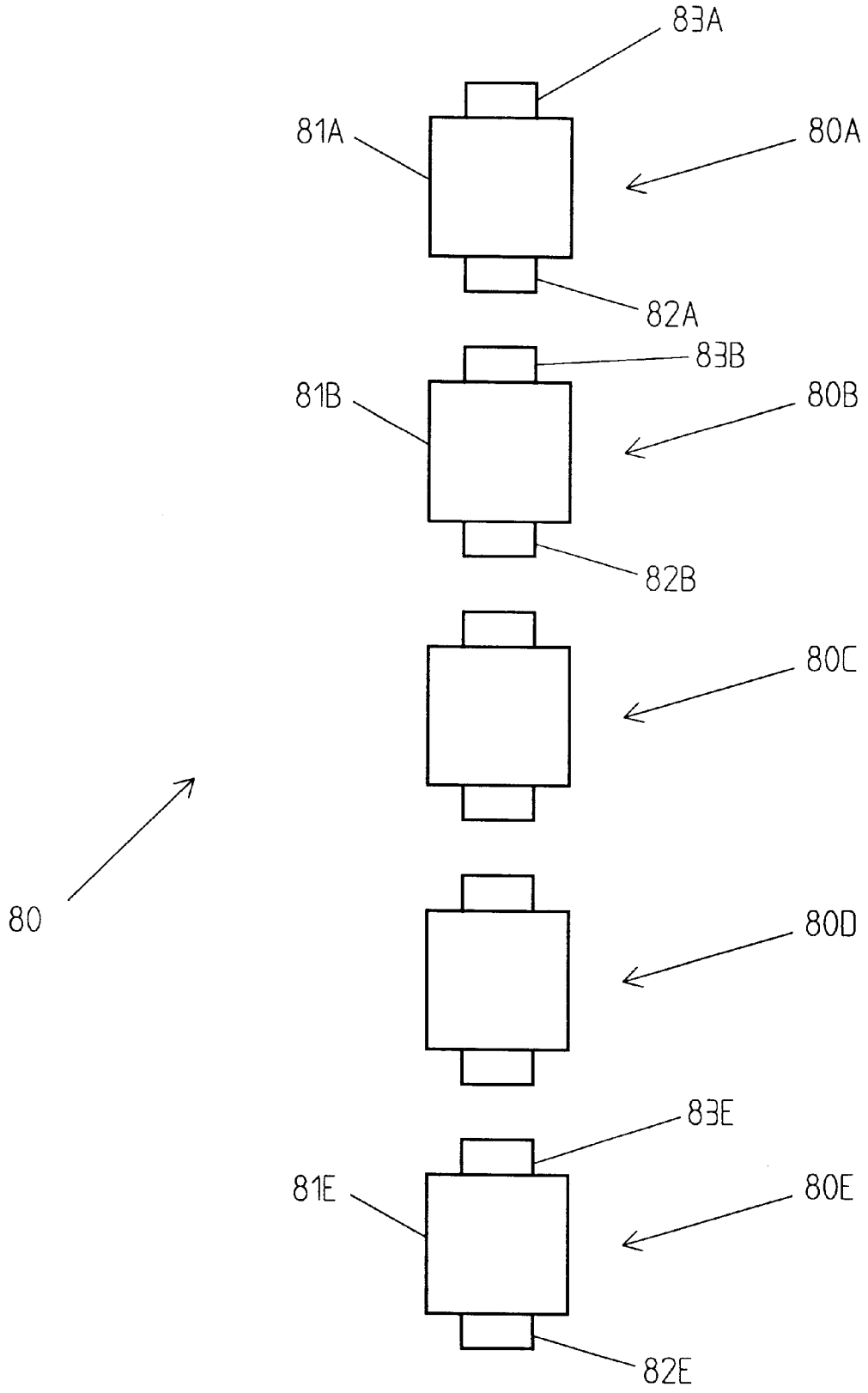
FIG. 13 is an example of a sector antenna arrangement.

FIG. 13 schematically illustrates an example of a sector antenna 80 according to the invention. The sector antenna comprises one column with a number of first radiating elements 81A, . . . , 81E, wherein to each first radiating element two second radiating elements 82A, 83A; . . . ; 82E, 83E are arranged. The second radiating elements are all arranged along a common vertical center line.

In alternative embodiments of sector antennas (not shown) one column of elements, e.g. as described with reference to anyone of FIG. 1A–FIG. 5 or any variant thereof, any kind of rotation etc., can be used, i.e. with two or four second radiating elements for each first radiating element.

Figure 14A:
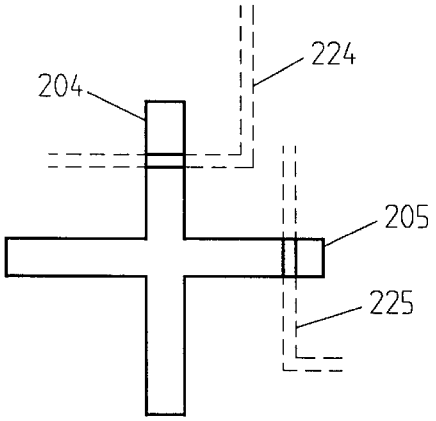
FIG. 14A is an example of an aperture according to an embodiment for a dual polarisation.
Figure 14B:
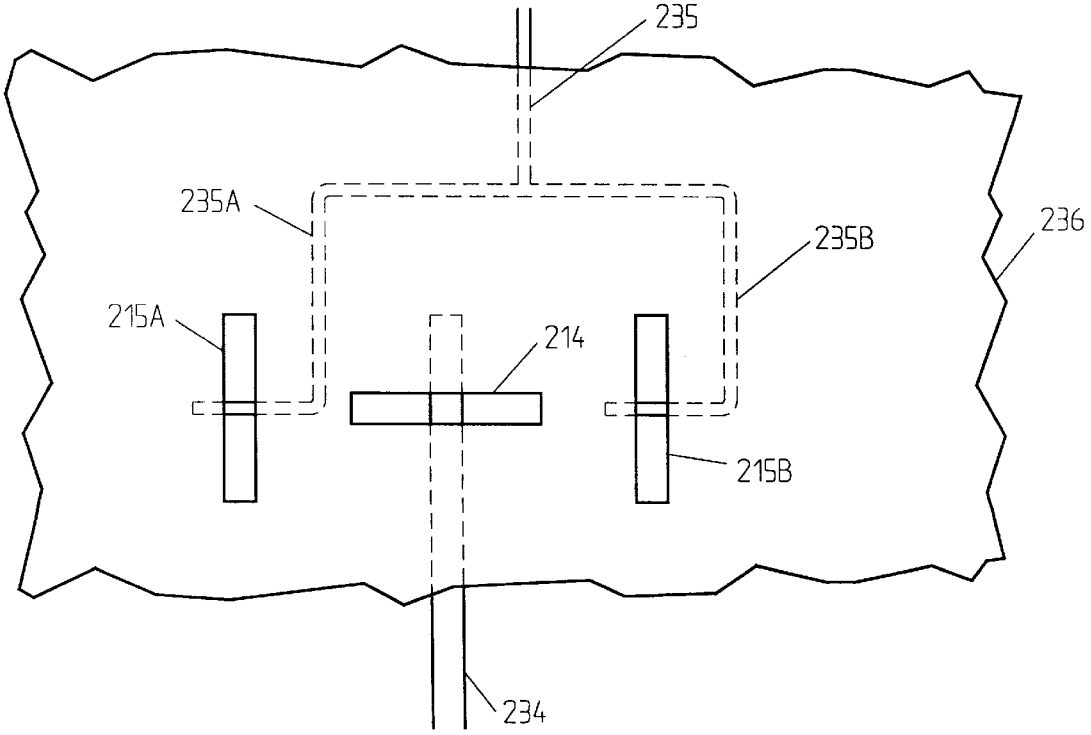
FIG. 14B is another example of an aperture for a dual polarisation arrangement.

For dual polarisation cases the apertures in the ground plane can take a form as illustrated in FIGS. 14A and 14B respectively. In FIG. 14A two slots 204, 205 cross each other in an orthogonal manner. They are fed by microstrip lines 224 and 225 respectively.

In FIG. 14B one of the slots can be said to be divided into two slots 215A,215B arranged in an orthogonal manner on both sides of a slot 214. Apertures as described in FIGS. 14A,14B then are arranged in the ground plane corresponding to each radiating element, the sizes depending on the size of the respective radiating element. There is one feeding microstrip line for each polarisation. The first microstrip line 234 orthogonally crosses the central slot 214 and a first and a second branch microstrip 235A,235B, respectively cross the slots 215A,215B. The branches are joined to form a common second microstrip line providing the second polarisation. The ground plane 236 is merely schematically indicated.

The invention is of course not limited to the shown embodiments but it can be varied in a number of ways, only being limited by the scope of the claims.

What is claimed is:

1. An antenna arrangement comprising a conductive ground plane, a number of first radiating elements radiating at a first frequency or in a first frequency band and a number of second radiating elements radiating at a second frequency or in a second frequency band, for each first radiating element a group of second radiating elements being arranged, wherein the first and the second radiating elements respectively are arranged in different planes, the second radiating elements in a group being symmetrically arranged, at least in pairs, in relation to the corresponding first radiating element in such a way that each second radiating element partly overlaps the corresponding first radiating element and wherein each radiating element has at least one effective resonant dimension, the effective resonant dimension of the first radiating element(s) being substantially twice that of the effective resonant dimensions of the second radiating elements so that the second radiating elements radiate at a frequency or in a frequency band which is approximately twice that of the first radiating element (s).

2. The arrangement of claim 1, wherein each radiating element comprises a patch of conductive material.

3. The arrangement of claim 2, wherein a layer of air is provided between the first and second radiating elements.

4. The arrangement of claim 2, wherein a dielectric material is arranged, at least partly occupying the space between layers of first and second radiating elements.

5. The arrangement according of claim 2, wherein between the ground plane and a lowest layer of radiating elements a dielectric material is arranged which at least partly occupies the space between the ground plane and the lowest layer of radiating elements.

6. The arrangement of claim 2, wherein the first and/or second radiating elements comprise rectangular patches.

7. The arrangement of claim 2, wherein the first and/or second radiating elements comprise square patches.

8. The arrangement of claim 2, wherein the first and/or the second radiating elements comprise circular patches.

9. The arrangement of claim 2, comprising one first radiating element and four second radiating elements.

10. The arrangement of claim 2, wherein for each of the number of first radiating elements, there are four corresponding second radiating elements, the elements being arranged in an array lattice.

11. The arrangement of claim 2, comprising one first radiating element and two second radiating elements.

12. The arrangement of claim 11, wherein the number of first radiating elements with corresponding second radiating elements are arranged in a column, forming a sector antenna.

13. The arrangement of claim 2, wherein at least one resonant dimension of the first radiating element is approximately half the wavelength ($\lambda_1/2$) corresponding to the first frequency and wherein the at least one resonant dimension of the second radiating elements is approximately half the wavelength ($\lambda_2/2$), corresponding to the second radiating frequency.

14. The arrangement of claim 2, wherein the first lower frequency radiating elements are arranged in a layer above a layer with second radiating elements.

15. The arrangement of claim 2, wherein apertures having resonant lengths approximately of the same size as the corresponding resonant dimensions are provided in the ground plane for aperture feeding.

16. The arrangement of claim 15, wherein the second radiating elements are arranged below the first radiating elements and the feeding is provided by a first and a second microstrip line exciting the first and second radiating elements through said apertures to have the intended frequencies.

17. The arrangement of claim 15, wherein for each radiating element a first aperture and a second aperture are provided in the ground plane, the first aperture providing a signal having a first polarisation and a first frequency and the second aperture providing a signal having a second polarisation.

18. The arrangement of claim 17, wherein the two apertures for a radiating element are arranged orthogonally in relation to each other.

19. An arrangement according to claim 1, wherein an air layer is provided between the ground plane and a lowest layer of radiating element(s).

20. The arrangement of claim 1, wherein only one linear polarisation is used.

21. The arrangement of claim 20, wherein similar polarisation are generated at both frequency bands.

22. The arrangement of claim 20, wherein the resonant dimensions of the first and the second radiating elements respectively form an angle of substantially 45° with each other so that the polarisation generated at the first and the second frequency sand respectively differ 45°.

23. The arrangement of claim 1, wherein dual polarisations are used and wherein each radiating element has two resonant dimensions.

24. The arrangement of claim 23, wherein similar polarisation are generated at both frequency bands.

25. The arrangement of claim 23, wherein the resonant dimensions of the first and the second radiating elements respectively form an angle of substantially 45° with each other so that the polarisation generated at the first and the second frequency band respectively differ 45°.

26. The arrangement of claim 23, wherein the second radiating elements are arranged above the first radiating element(s).

27. The arrangement of claims 1, wherein the second radiating elements are arranged above the first radiating element(s).

28. The arrangement of claims 1, wherein probe feeding is used.

29. The arrangement of claim 1, wherein the first radiating elements and the second radiating elements are excited independently.

30. A base station antenna arrangement for mobile telecommunications comprising a number of first antennas intended for a mobile telecommunications system operating in a first frequency band, and further comprising a number of second antennas for a mobile telecommunications system operating in a second frequency band being approximately twice that of the first frequency band, so that the antennas for the first and the second system use one antenna aperture, the first and second antennas comprising an antenna arrangement in which groupwise to a number of first radiating elements a number of second radiating elements are arranged in a different plane so that the group of second radiating elements partly overlap the corresponding first radiating element, the resonant dimension of the first radiating element being substantially twice that of the second radiating elements.

31. The base station antenna arrangement of claim 30, wherein the frequencies of the second frequency band are about a factor 1.6–2.25 times the frequencies of the first frequency band.

32. The base station antenna arrangement of claim 30, wherein the antennas are sector antennas or multi-beam array antennas.

33. The base station antenna arrangement of claim 30, wherein the first system operates in the 800–900 MHz frequency band, and wherein the second system operates in approximately the 1800–1900 MHz frequency band.

34. The base station antenna arrangement of claim 30, wherein the first radiating elements and the second radiating elements are excited independently.

* * * * *